US008704858B2

(12) United States Patent
Tobita et al.

(10) Patent No.: US 8,704,858 B2
(45) Date of Patent: Apr. 22, 2014

(54) DISPLAY UNIT WITH LUMINANCE AND CHROMATICITY CORRECTION USING COMPRESSED CORRECTION MATRIX

(75) Inventors: Hiroshi Tobita, Kanagawa (JP); Takehiro Misonou, Kanagawa (JP)

(73) Assignee: Sony Corporation (JP)

( * ) Notice: Subject to any disclaimer, the term of this patent is extended or adjusted under 35 U.S.C. 154(b) by 502 days.

(21) Appl. No.: 12/494,791

(22) Filed: Jun. 30, 2009

(65) Prior Publication Data

US 2010/0002022 A1 Jan. 7, 2010

(30) Foreign Application Priority Data

Jul. 2, 2008 (JP) ..... 2008-173095

(51) Int. Cl.
*G09G 5/10* (2006.01)
*G09G 3/32* (2006.01)

(52) U.S. Cl.
USPC ..... 345/690; 345/83

(58) Field of Classification Search
USPC ..... 345/88, 690
See application file for complete search history.

(56) References Cited

U.S. PATENT DOCUMENTS

| | | | | |
|---|---|---|---|---|
| 4,266,242 | A * | 5/1981 | McCoy | 348/588 |
| 4,719,503 | A * | 1/1988 | Craver et al. | 348/717 |
| 5,726,910 | A * | 3/1998 | Toma | 358/518 |
| 6,020,868 | A * | 2/2000 | Greene et al. | 345/88 |
| 6,243,059 | B1 * | 6/2001 | Greene et al. | 345/88 |
| 6,320,594 | B1 * | 11/2001 | Young | 345/605 |
| 6,411,047 | B1 * | 6/2002 | Okazaki et al. | 315/312 |
| 6,750,875 | B1 * | 6/2004 | Keely et al. | 345/613 |
| 6,888,961 | B1 * | 5/2005 | Tamagawa et al. | 382/162 |
| 7,010,033 | B2 * | 3/2006 | Clark | 375/240.01 |
| 7,215,366 | B2 * | 5/2007 | Mori et al. | 348/223.1 |
| 7,265,781 | B2 * | 9/2007 | Noguchi | 348/223.1 |
| 7,345,713 | B2 * | 3/2008 | Arai et al. | 348/687 |
| 7,586,640 | B2 * | 9/2009 | Hoshuyama | 358/1.9 |
| 7,859,499 | B2 * | 12/2010 | Furukawa | 345/88 |
| 7,898,550 | B2 * | 3/2011 | Prokopenko et al. | 345/555 |
| 7,940,329 | B2 * | 5/2011 | Houmeau et al. | 348/383 |
| 2002/0030449 | A1 * | 3/2002 | Okazaki et al. | 315/169.1 |
| 2005/0083352 | A1 * | 4/2005 | Higgins | 345/690 |
| 2005/0253785 | A1 * | 11/2005 | Miyasaka et al. | 345/63 |
| 2006/0109276 | A1 * | 5/2006 | Ooga et al. | 345/530 |
| 2006/0158536 | A1 * | 7/2006 | Nakayama | 348/254 |
| 2006/0208983 | A1 * | 9/2006 | Lee et al. | 345/89 |
| 2007/0211073 | A1 * | 9/2007 | Sambongi | 345/602 |
| 2008/0007565 | A1 * | 1/2008 | Nogawa et al. | 345/597 |
| 2008/0018798 | A1 * | 1/2008 | Park et al. | 348/655 |
| 2008/0284702 | A1 * | 11/2008 | Shidara et al. | 345/90 |
| 2009/0167904 | A1 * | 7/2009 | Matsushima | 348/241 |
| 2010/0189350 | A1 * | 7/2010 | Shohara | 382/167 |
| 2011/0149166 | A1 * | 6/2011 | Botzas et al. | 348/649 |

FOREIGN PATENT DOCUMENTS

| | | |
|---|---|---|
| JP | 2000-155548 | 6/2000 |
| JP | 2001-188513 | 7/2001 |

* cited by examiner

*Primary Examiner* — Amare Mengistu
*Assistant Examiner* — Sarvesh J Nadkarni
(74) *Attorney, Agent, or Firm* — Sheridan Ross P.C.

(57) ABSTRACT

A display unit includes: a display section including a plurality of pixels, each of the pixels including a plurality of light-emitting devices; an operation section that performs calculations for correcting drive signals to be inputted into the light-emitting devices of the pixels included in the display section in order to correct luminances and chromaticities of the pixels; and a coefficient data input section where a bit number of an element having smaller variations in coefficient in the display section, among elements of each of coefficient matrixes necessary for the correction calculations, the coefficient matrixes to be inputted into the operation section, is set to a value smaller than a bit number of an element having larger variations.

5 Claims, 6 Drawing Sheets

ELEMENT ARRAY OF 3 × 3 MATRIX DATA

DISPLAY UNIT WITH LUMINANCE AND CHROMATICITY CORRECTION USING COMPRESSED CORRECTION MATRIX

BACKGROUND OF THE INVENTION

1. Field of the Invention

The present invention relates to a display unit that displays images by controlling multiple light-emitting devices included in each pixel using video signals.

2. Description of the Related Art

In a color display unit that includes an array of light-emitting devices, such as LEDs (light-emitting diodes), and makes fine display by driving the light-emitting devices individually, the luminance and chromaticity vary among the pixels due to such as manufacturing variations in the light-emitting devices even if same video signals are inputted into the light-emitting devices. As a result, the image quality is reduced. For this reason, there has been presented a method of correcting signals to be inputted into the light-emitting devices by performing 3×3-matrix operations on the video signals, as disposed in Japanese Unexamined Patent Application Publication Nos. 2000-155548 and 2001-188513.

The above-mentioned method will be described briefly. In one pixel, video input signal Ri, Gi, and Bi are converted into signals Ro, Go, and Bo to be inputted into LEDs, by performing matrix operations shown in Formula 1 (Formulas (a) and (b)) described below. By performing such correction, the pixel is displayed with the luminance and chromaticity intended by the video input signals.

[Formula 1]

$$\begin{pmatrix} Ro \\ Go \\ Bo \end{pmatrix} = M \begin{pmatrix} Ri \\ Gi \\ Bi \end{pmatrix} \quad \text{Formula (a)}$$

$$M = \begin{pmatrix} Lr1 & Lg1 & Lb1 \\ Lr2 & Lg2 & Lb2 \\ Lr3 & Lg3 & Lb3 \end{pmatrix}^{-1} \begin{pmatrix} Sr1 & Sg1 & Sb1 \\ Sr2 & Sg2 & Sb2 \\ Sr3 & Sg3 & Sb3 \end{pmatrix} \quad \text{Formula (b)}$$

Lr1, Lr2, and Lr3 in Formula (b) are values determined by measuring the luminances and chromaticities of an R (red) LED of this pixel, Lg1, Lg2, and Lg3 are values determined by measuring the luminance and chromaticity of a G (green) LED of this pixel, and Lb1, Lb2, Lb3 are values determined by measuring the luminance and chromaticity of a B (blue) LED of this pixel, and Sr1, Sr2, Sr3, Sg1, Sg2, Sg3, Sb1, Sb2, and Sb3 are values determined on the basis of the color gamut conceived by these video signals.

In order to obtain a display unit that corrects the luminance and chromaticity using these Formulas, the luminance and chromaticity of R, G, and B of all pixels are measured in advance, a matrix M is obtained with respect to each pixel by performing a calculation, and the obtained matrixes M are stored in a memory or the like. Then, during operation of the display unit, real-time operations are performed on these matrixes M and video signals to obtain LED signals, and display is made by driving the LEDs in accordance with the obtained LED signals.

SUMMARY OF THE INVENTION

However, if the number of pixels included in the display unit is increased, an enormous number of matrix operations have to be performed. For example, as for a display unit having a frame rate of 60 frame/sec. and including 1980×1080 pixels, 3×3 matrix operations have to be performed on each pixel. Specifically, about 2,000,000×60=120,000,000 3×3-matrix operations are performed per second. As a result, the following problems occur.

(1) Assuming that each element of a matrix M is one byte, a large, high-speed memory of about 19 Mbytes is necessary.

(2) About 120,000,000 3×3 matrix operations are performed per second, so power consumption is increased.

It is desirable to provide a display unit that is allowed to reduce the number of matrix operations necessary to perform calculations for correcting the luminance and chromaticity so as to obtain the same correction effect with less calculations while reducing power consumption.

According to an embodiment of the present invention, a display unit includes: a display section including a plurality of pixels, each of the pixels including a plurality of light-emitting devices; an operation section that performs calculations for correcting drive signals to be inputted into the light-emitting devices of the pixels included in the display section in order to correct luminances and chromaticities of the pixels; and a coefficient data input section where a bit number of an element having smaller variations in coefficient in the display section, among elements of each of coefficient matrixes necessary for the correction calculations, the coefficient matrixes to be inputted into the operation section, is set to a value smaller than a bit number of an element having larger variations.

According to the embodiment of the present invention, each of elements of coefficient matrixes necessary to perform calculations for correcting the luminance and chromaticity is assigned a necessary number of bits. As a result, the whole bit number is reduced so that the same correction effect can be obtained with less calculations.

According to the embodiment of the present invention, the number of matrix operations required for calculations for correcting variations in luminance and chromaticity is reduced so that the same correction effect can be obtained with less calculations. This can eliminate the need to use a memory operable at higher speed than required, as well as can reduce power consumption.

DESCRIPTION OF THE PREFERRED EMBODIMENT

Configuration of Display Unit

Now, an embodiment of the present invention will be described with reference to the accompanying drawings.

Figure 1:
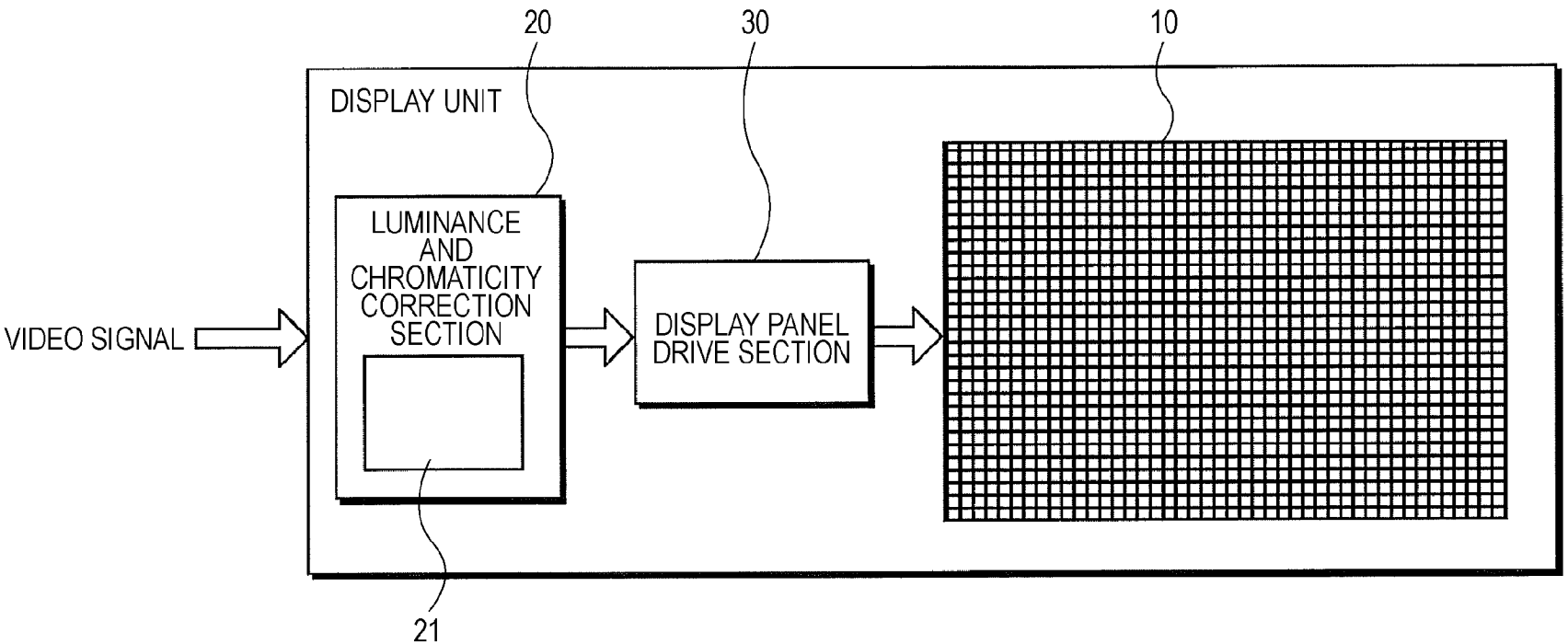
FIG. 1 is a block diagram showing a configuration of a display unit according to an embodiment of the present invention.

FIG. 1 is a block diagram showing a configuration of a display unit according to this embodiment. The display unit according to this embodiment includes three major elements, that is, a display panel 10, a luminance and chromaticity correction section 20, and a display panel drive section 30.

Figure 2:
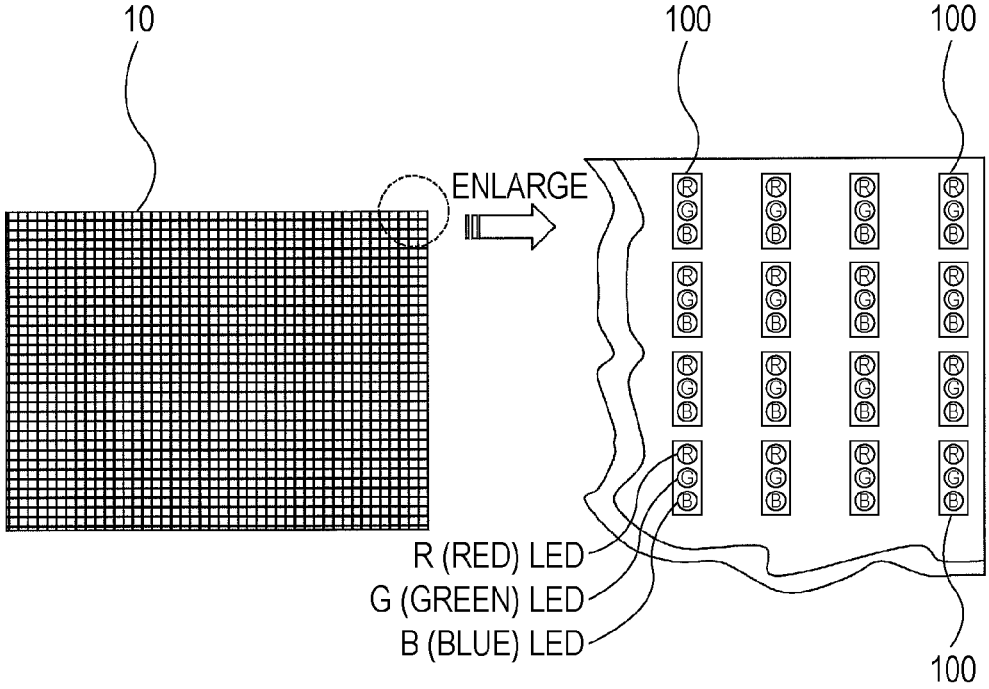
FIG. 2 is a partial enlarged view showing the display unit in detail.

The display panel 10 includes an array of multiple pixels each including multiple light-emitting devices. FIG. 2 is a partial enlarged view showing the display unit in detail. In this embodiment, one pixel 100 includes three LEDs corresponding to R (red), G (green), and B (blue). In the display panel 10, multiple pixels 100 are disposed vertically and laterally (for example, 1920 pixels laterally and 1080 pixels vertically) so that video pictures are displayed.

The luminance and chromaticity correction section 20 is a section that receives, for example, video signals corresponding to R (red), G (green) and B (blue) and generates an R correction signal, a G correction signal, and a B correction signal to serve as signals for driving the light-emitting devices of the pixels included in the display panel 10 by performing predetermined operations. The luminance and chromaticity correction section 20 includes a matrix data memory 21 storing coefficient matrixes (matrix data) to be used in these operations. The matrix data memory 21 may be an external storage device. The luminance and chromaticity correction section 20 will be described in detail later.

The display panel drive section 30 is a section that drives the light-emitting devices of each pixel on the basis of an R correction signal, a G correction signal, and a B correction signal generated by the luminance and chromaticity correction section 20. More Specifically, the display panel drive section 30 controls light emission by providing drive signals to the corresponding light-emitting devices of the pixels due to, for example, PWM (pulse wide modulation) on the basis of R signals, G signals, and B signals outputted from the luminance and chromaticity correction section 20.

Details of Luminance and Chromaticity Correction Section

Figure 3:
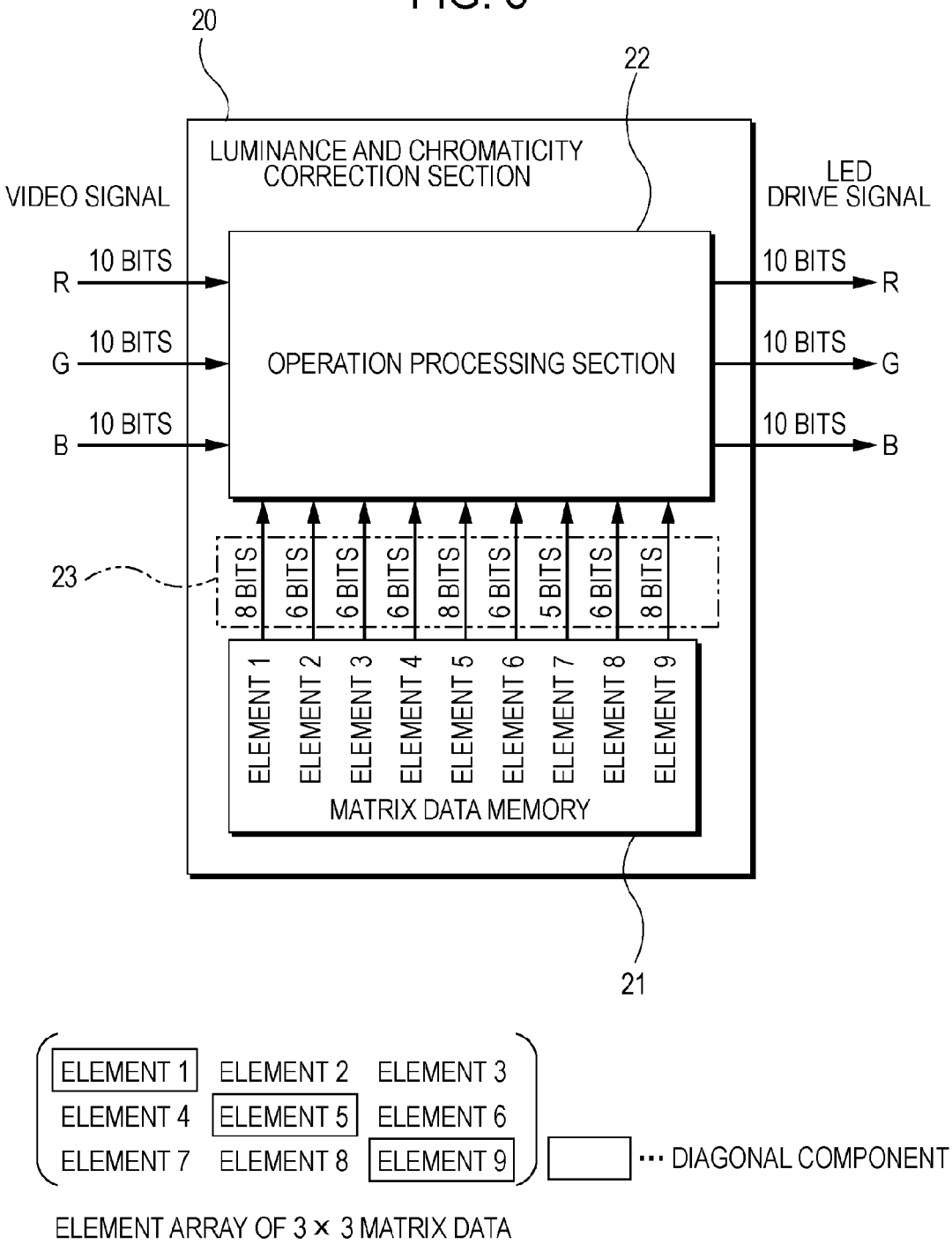
FIG. 3 is a drawing showing a detailed configuration of a luminance and chromaticity correction section.

FIG. 3 a drawing showing a detailed configuration of the luminance and chromaticity correction section. The luminance and chromaticity correction section 20 is a section that corrects video signals into drive signals by providing coefficient matrixes to an operation processing section 22. In an example shown in FIG. 3, the luminance and chromaticity correction section 20 includes a storage section (matrix data memory 21) storing matrix data, which is coefficient matrixes, in addition to the operation processing section 22. The matrix data memory 21 is a high-speed, non-volatile memory and may be included in the luminance and chromaticity correction section 20 or may be an external storage unit as necessary.

The operation processing section 22 is formed by a digital operation circuit. The luminance and chromaticity correction section 20 performs matrix operations on the received R video signal, G video signal, and B video signal corresponding to the pixels and the elements of coefficient matrixes sent from the matrix data memory 21 and outputs the operation results as drive signals for driving the R light-emitting device, G light-emitting device, and B light-emitting device of the pixels. In this embodiment, bit numbers are set for the elements in a coefficient data input section 23 that inputs the values of elements of matrix data sent from the matrix data memory 21 to the operation processing section 22.

That is, in the coefficient data input section 23, the bit number of an element having smaller variations in coefficient in the pixels included in the display panel, among the elements of matrix data to be provided to the operation processing section 22, is set to a value smaller than that of an element having larger variations.

In an example shown in FIG. 3, 3×3 matrix data is used, and coefficients corresponding to nine elements (elements 1 to 9) are inputted into the operation processing section 22 with a predetermined bit number. That is, pieces of coefficient data corresponding to the elements 1 to 9 are inputted from the matrix data memory 21 to the operation processing section 22 in parallel. The coefficient data input section 23 is a section that transfers these pieces of coefficient data. For example, a minimum of 5 bits to a maximum of 8 bits are set for the elements 1 to 9 by assigning weights in accordance with variations among the elements in the display panel.

Specifically, the bit numbers of elements other than the bit numbers of elements that are diagonal components of a coefficient matrix forming matrix data are set to values smaller than those of the diagonal components. As shown, 3×3 matrix data is a matrix including the elements 1 to 9. Among these elements, the diagonal components are the elements 1, 5, and 9. The bit numbers of the elements 1, 5, and 9 are set to values larger than those of the other elements.

Details of the matrix data is disclosed in Japanese Unexamined Patent Application Publication No. 2000-155548. The matrix data is obtained by organizing the matrixes corresponding to M in the above-mentioned Formula (b). A specific example of the matrix data is values as shown in Japanese Unexamined Patent Application Publication No. 2000-155548, paragraph 0035.

Formula 2 shows an example of 3×3 matrix data shown in Japanese Unexamined Patent Application Publication No. 2000-155548. This matrix data is determined by actually measuring each of the elements included in the display panel and has predetermined variations in the display panel. In particular, the diagonal components (see rectangle frames in the drawing) of 3×3 matrix data are main elements as correction coefficients and significantly vary among the pixels. On the other hand, the other elements are auxiliary correction coefficients and therefore vary among the pixels to a lesser extent.

[Formula 2]

$$\begin{pmatrix} \boxed{1.0300} & 0.0404 & 0.0247 \\ 0.0482 & \boxed{0.8975} & 0.0075 \\ 0.0103 & 0.0534 & \boxed{1.0885} \end{pmatrix} \qquad \text{Formula (c)}$$

The characteristics of variations in the elements of the matrix data as described above will be used. As for elements having smaller variations, any pixels have values close to each other. Therefore, when the elements are converted into digital signals, parts of the bit numbers of the elements may be omitted. On the other hand, elements having larger variations have to be sent without omitting the bit numbers thereof.

In an example of the coefficient data input section shown in FIG. 3, among the nine elements, elements that are diagonal components having large variations are sent with 8 bits to the operation processing section, and elements that are the other components are omitted into 6 or 5 bits and then sent to the operation processing section. Also, it is possible to form operation circuits corresponding to such bit numbers of the elements in the operation processing section. Therefore, the circuit configuration is reduced compared with a case where circuits are formed in accordance with the bit numbers (e.g., 8 bits) of elements having large variations with respect to all the elements.

Operations of Display Unit

Operations of the display unit according to this embodiment will be described using the block diagram shown in FIG. 1. This display unit sequentially receives video signals that are serialized on a pixel-by-pixel basis and correspond to R, G, B.

When an R signal, a G signal, and a B signal corresponding to a pixel are inputted, the luminance and chromaticity correction section 20 reads 3×3 matrix data that is stored in advance and corresponds to the pixel, and performs the operation shown in Formula (a) on the R video signal, G video signal, and B video signal and the 3×3 matrix data. Thus, the inputted R video signal, G video signal, and B video signal are modulated so that variations among light-emitting devices (LED) of an identical color are corrected, and then outputted to the subsequent display panel drive section 30.

The display panel drive section 30 simply drives the light-emitting devices of the pixel in intended colors in accordance with the received signals, that is, the signals corrected by the luminance and chromaticity correction section 20. Thus, even if there are variations among the light-emitting devices (LED), display can be made in the luminance and chromaticity intended by the video signals.

By sequentially performing such operations and drive with respect to all the pixels, images having no unevenness are displayed even if there are variations in luminance and chromaticity among the corresponding display elements (LED) of the pixels of the display panel 10.

Bit Number Setting Method and Design Method

Next, the setting of the bit number in the coefficient data input section, which is a characteristic of this embodiment, will be described. The bit number of each element in the coefficient data input section is necessary in the stage of designing the display unit. That is, the bit numbers of the elements of a coefficient matrix are determined in the design stage, and the determined bit numbers are reflected on the design of the matrix data memory and the operation processing section.

Figure 4:
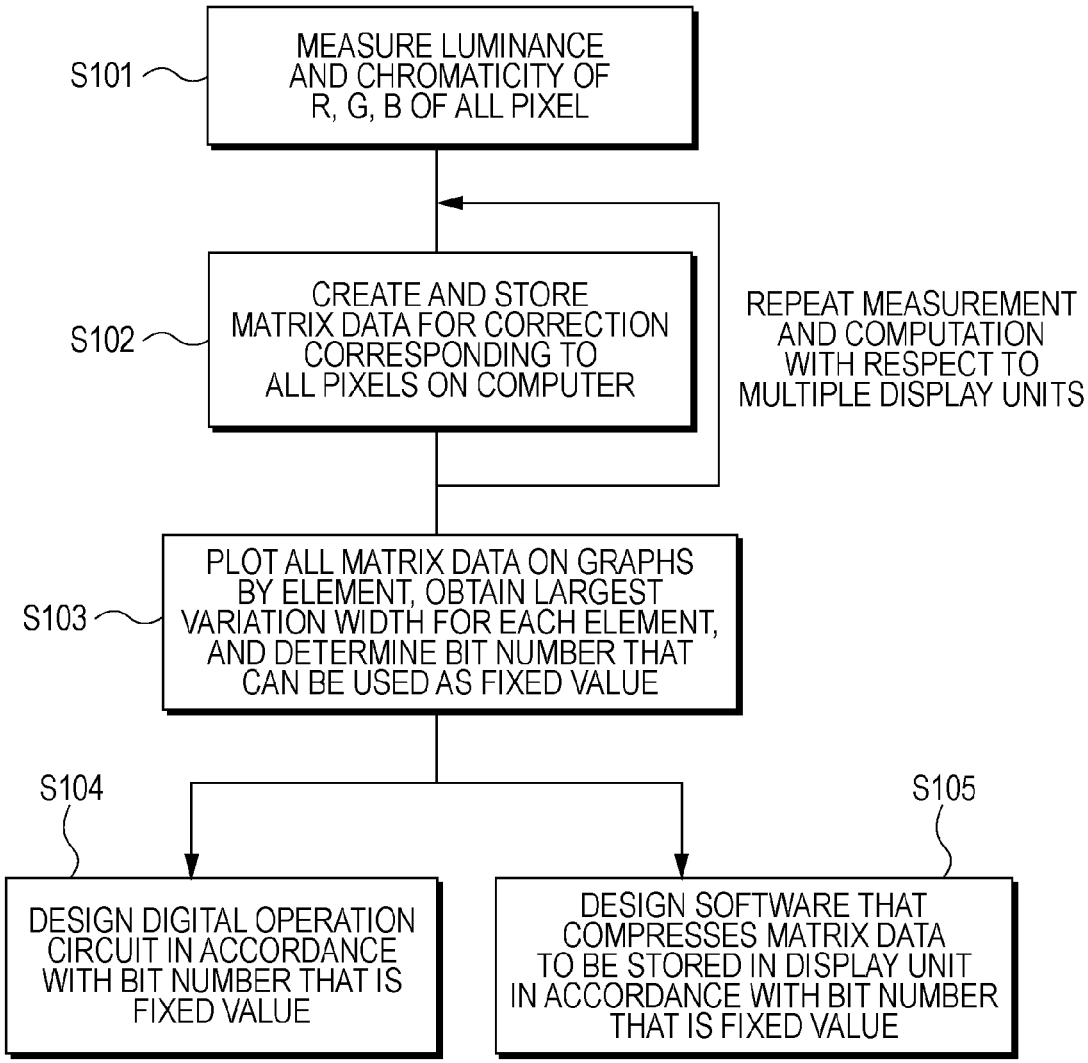
FIG. 4 is a flowchart showing steps of a bit number setting and designing method.

FIG. 4 is a flowchart showing the steps of a bit number setting and designing method. First, in order to obtain the luminance and chromaticity of the R LED, G LED, and B LED of each pixel, which are necessary to perform the matrix calculation shown in Formula (a), the luminance and chromaticity of the LEDs of all the pixels of the display panel are measured (step S101). In this embodiment, the luminance and chromaticity are measured with respect to the LEDs of all the pixels of the display panel; however, for example, assuming that LEDs manufactured in an identical lot have identical performance, the luminance and chromaticity of LEDs may be measured on a lot-by-lot basis.

Next, the color gamut ($x_R$,$y_R$,$x_G$,$y_G$,$x_B$,$y_B$) of a video signal is set in advance. Then, from this color gamut and the luminance and chromaticity of the LEDs obtained the measurements, matrix data M for correction shown in Formula (b) is calculated for a certain pixel. The matrix data M is synthesized into a 3×3 matrix. This is repeatedly performed with respect to all the measured pixels. In this way, pieces of matrix data M for correction corresponding to all the pixels of the display panel are created and stored (step S102).

Next, in order to obtain the state of variations among the pieces of matrix data in this product, pieces of matrix data for correction are created with respect to multiple display units as described above, and the pieces of matrix data for each display unit are stored.

Next, the pieces of matrix data corresponding to the multiple display units obtained in the above-mentioned way are plotted on graphs on an element-by-element basis, and the largest variation width is obtained with respect to each element. Then, the bit number of each element is determined in accordance with this variation width (step S103).

Figure 5:
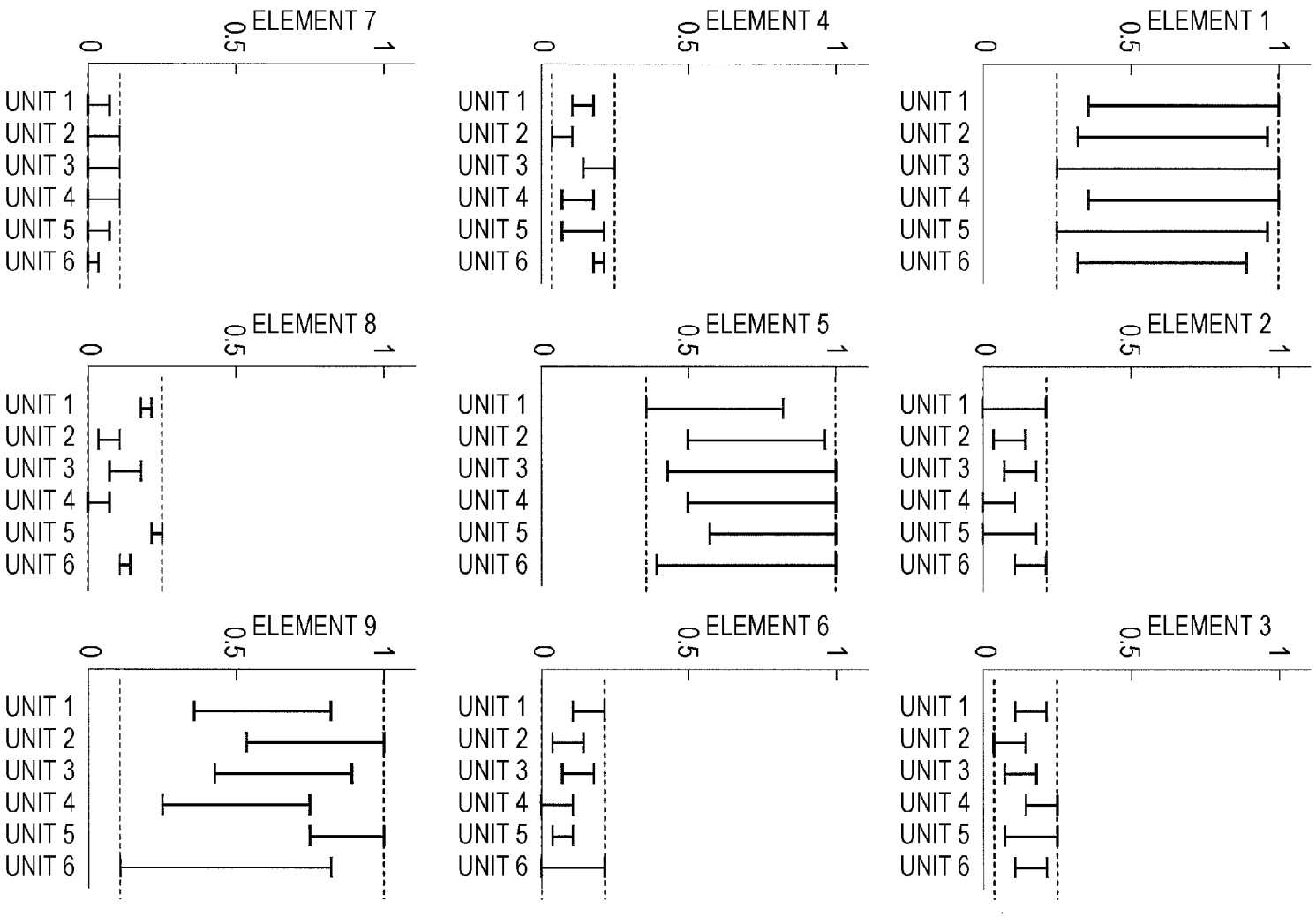
FIG. 5 includes graphs where pieces of matrix data in multiple display units are plotted on an element-by-element basis.

FIG. 5 includes graphs where the pieces of matrix data in the multiple display units are plotted on an element-by-element basis. In the drawing, the left to right graphs in the upper row correspond to the elements 1 to 3, the left to right graphs in the middle row correspond to the elements 4 to 6, and the left to right graphs in the lower row correspond to the elements 7 to 9. Each graph shows variations in one element among the six display units.

For example, if data representing one element is typically represented by 8 bits and if the range of variations in the data is equal to or larger than 0 and equal to or smaller than 0.25, the upper 2 bits are 0. Therefore, it is sufficient to store only the lower 6 bits as the data in the matrix data memory. Also, if the variation range is smaller than the above-mentioned range, it is sufficient to store only a smaller number of bits in the matrix data memory.

On the other hand, if the variation range exceeds 0.25, all the bits of the data are stored in the matrix data memory. For example, if the data is typically represented by 8 bits, the data is stored as 8-bit data in the matrix data memory.

In an example shown in FIG. 5, the elements 1, 5, and 9, which are diagonal elements, among the nine elements of 3×3 matrix data, are major correction coefficient components and thus have large variations. Therefore, these elements are represented by 8 bits. On the other hand, the other elements are auxiliary correction coefficient components and thus have smaller variations. Therefore, these elements are represented by 5 or 6 bits in accordance with the variation range thereof.

If the bit number of each element is determined as described above, a format for storing coefficient data in the matrix data memory and a digital operation circuit for forming the operation processing section are determined (step S104).

If the bit numbers as shown in FIG. 3 are determined on the basis of the variations among the elements shown in FIG. 5, it is sufficient to prepare circuits for performing operations on a 10-bit input signal and 8-bit correction coefficient data, on a 10-bit input signal and 6-bit correction coefficient data, and on a 10-bit input signal and 5-bit correction coefficient data as multipliers in an operation circuit, that is, it is sufficient to prepare circuits for 10 bits×8 bits, 10 bits×6 bits, and 10 bits×5 bits. Therefore, not all the circuits have to be circuits for 10 bits×8 bits.

Also, when the range of variations in each element of matrix data is obtained, software for compressing matrix data is created (step S105).

This software is software for performing a process of compressing and packaging the elements of matrix data for each pixel into a predetermined number of bits and a process of transferring the packaged matrix data to the matrix data memory of the display unit.

That is, the computer is storing pieces of matrix data obtained from the values of the luminance and chromaticity of the light-emitting devices of each pixel of each display unit measured in advance. The elements of each of the pieces of matrix data obtained from the measurement values all have a value represented by a same bit number (e.g., 8 bits).

The software is executed by the computer so that the pieces of matrix data stored in the computer are compressed in accordance with the previously determined bit numbers of the elements and packaged in the order of the elements. Also, the software performs a process of transferring the compressed matrix data to the matrix data memory (or another storage section) of the display unit.

By using this software, for example, 3×3 matrix data including nine elements for each pixel is packaged in a state where the matrix data is stored continuously in accordance with the previously determined bit numbers of the nine elements, and transferred to the display unit in this state.

Display Unit Manufacturing Method

Figure 6:
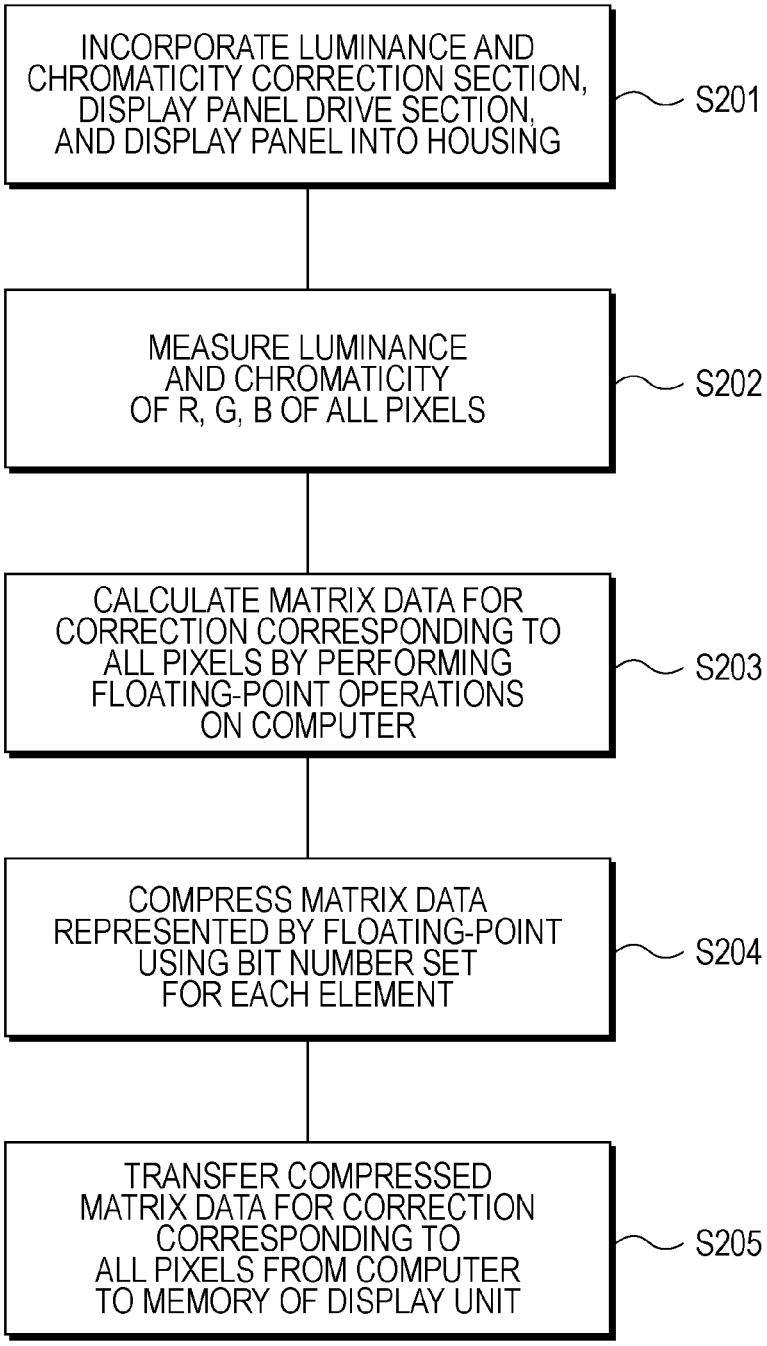
FIG. 6 is a flowchart showing an example of a manufacturing flow of the display unit according to this embodiment.

FIG. 6 is a flowchart showing an example of a manufacturing flow of the display unit according to this embodiment.

First, the above-mentioned luminance and chromaticity correction section, display panel drive section, and display panel are manufactured and then incorporated into a desired housing (step S201). Then, the luminance and chromaticity of the R LED, G LED, and B LED of all the pixels of the display panel are measured while causing the pixels to emit light (step S202).

Next, matrix data M for correction shown in Formula (b) is calculated by causing the computer to perform floating-point arithmetic on the fixed color gamut of video signals and the measured luminances and chromaticities of the LEDs (step S203). Matrix data M for correction is calculated for example, with respect to all the pixels.

Subsequently, the matrix data M for correction is compressed on the computer on the basis of the calculation result of the matrix data M, the previously obtained position of the omitted bits of each element, and the fixed value thereof (step S204). This compression is performed using the software designed in step S105.

The compressed data is data packaged in a state where nine pieces of coefficient data (nine elements) of matrix data corresponding to each pixel are stored sequentially and continuously in accordance with the previously determined bit numbers.

Subsequently, the compressed pieces of matrix data corresponding to all the pixels are transferred from the computer to the storage section (for example, non-volatile memory) of the display unit, such as the matrix data memory (step S205).

In this way, an operation circuit or a memory that is assigned only a necessary number of bits as a bit number for handling each element data of matrix data is applied to the display unit that corrects video signals using matrix data corresponding to each pixel.

Application Example

A SRAM (static random access memory) may be used as the storage section for storing matrix data, of the luminance and chromaticity correction section shown in FIG. 1 and a non-volatile memory may be added separately. Thus, matrix data is transferred from the non-volatile memory to the SRAM when the display unit is started. In this case, the sizes of the two memories, SRAM and non-volatile memory, are reduced.

Also, the light-emitting devices included in the pixels of the display panel are not limited to LEDs and may be other light-emitting devices such as organic EL (electroluminescence) devices. Also, the colors of the light-emitting devices included in the pixels are not limited to the three colors, R, G, and B. Four or more colors including at least one of R, G, and B may be used or other colors may be used. In this case, matrix data having a matrix corresponding to the number of light-emitting devices included in one pixel is used.

Advantages of Embodiment

By adopting the display unit according to the above-mentioned embodiment, the following advantages are obtained.

(1) While a given bit number (e.g., 8 bits) is typically necessary with respect to each element of data matrix, the bit number can be reduced with respect to elements having smaller variations. For example, if a total of 8 bits can be omitted from nine elements, it is sufficient to have a capacity of a total of 64 bits, although a capacity of a total of 72 bits is typically necessary. Thus, it is sufficient to have a minimum of two 32-bit RAMs, although a minimum of three 32-bit RAMs are typically necessary. This allows a reduction in number of memories mounted on the display unit.

(2) The size of the digital operation circuit for correcting the luminance and chromaticity can be reduced, so the power consumption of the display unit can be reduced.

(3) The total size of correction matrix data is reduced, so the time taken when correction matrix data is transferred from the computer to the display unit during manufacture can be reduced.

The present application contains subject matter related to that disclosed in Japanese Priority Patent Application JP 2008-173095 filed in the Japan Patent Office on Jul. 2, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display unit comprising:

a display section including a plurality of pixels, each of the pixels including a plurality of light-emitting devices;

an operation section that performs calculations for correcting drive signals to be input into the light-emitting devices of the pixels included in the display section in order to correct luminances and chromaticities of the pixels; and a coefficient data input section that provides coefficient values of elements of matrix data to the operation section, said coefficient data input section handling coefficient values having different bit lengths and being set such that a number of bits of an element that corresponds to coefficient values with smaller variations among the elements of matrix data for the calculations is less than a number of bits of an element that corresponds to coefficient values with larger variations, wherein a number of bits of an element other than an element that is a diagonal component of each of the coefficient matrixes is set to a value smaller than a number of bits of the element that is the diagonal component.

2. The display unit according to claim 1, wherein the matrix data to be input to the operation section includes three-by-three elements corresponding to one of the light-emitting devices included in the pixels, the light-emitting devices corresponding to three colors, the three colors being red, green, and blue.

3. The display unit according to claim 1, further comprising a storage section that stores the elements of the matrix data in such a manner that the number of bits that are stored for each respective element corresponds to the number of bits that has been set in the coefficient data input section.

4. The display unit according to claim 1, wherein the light-emitting devices included in the pixels of the display section are light-emitting diodes.

5. The display unit according to claim 1, wherein the operation section is configured to perform calculations on an input signal of a first bit length with a correction coefficient of a second bit length that is different from the first bit length.

* * * * *